US006155361A

United States Patent [19]

Patterson

[11] Patent Number: 6,155,361

[45] Date of Patent: Dec. 5, 2000

[54] HYDRAULIC IN-THE-HOLE PERCUSSION ROCK DRILL

[76] Inventor: William N. Patterson, 2796 Foxtail Way, Montrose, Colo. 81404

[21] Appl. No.: 09/239,141

[22] Filed: Jan. 27, 1999

[51] Int. Cl.[7] ..... E21B 4/14

[52] U.S. Cl. ..... 175/296; 173/13; 173/73

[58] Field of Search ..... 173/13, 15, 16, 173/17, 73, 78, 80, 91, 112, 138, 206; 175/19, 93, 296, 297; 91/50, 57, 269

[56] References Cited

U.S. PATENT DOCUMENTS

| | | |
|---|---|---|
| 3,896,889 | 7/1975 | Bouyoucos . |
| 3,903,972 | 9/1975 | Bouyoucos et al. . |
| 4,006,783 | 2/1977 | Granholm . |
| 4,022,108 | 5/1977 | Juvonen . |
| 4,044,844 | 8/1977 | Harris et al. . |
| 4,084,486 | 4/1978 | Juvonen . |
| 4,150,603 | 4/1979 | Etherington . |
| 4,474,248 | 10/1984 | Musso . |
| 4,646,854 | 3/1987 | Arndt et al. . |
| 4,660,658 | 4/1987 | Gustafsson . |
| 4,828,048 | 5/1989 | Mayer et al. . |
| 5,014,796 | 5/1991 | Gustafsson . |
| 5,107,944 | 4/1992 | Gustafsson . |
| 5,680,904 | 10/1997 | Patterson . |
| 5,715,897 | 2/1998 | Gustafsson . |

FOREIGN PATENT DOCUMENTS

WO 92/01138 1/1992 WIPO .

*Primary Examiner*—Robert E. Perruto

*Attorney, Agent, or Firm*—Akin, Gump, Strauss, Hauer & Feld, LLP

[57] ABSTRACT

A hydraulic reciprocating piston hammer percussion drill includes an elongated piston hammer having opposed reduced diameter shank portions and disposed in a cylinder for reciprocating movement in response to pressure fluid acting continuously on one transverse face of the piston hammer and in response to valving of pressure fluid alternately to an opposed piston face of the piston hammer by a tubular sleeve valve which is disposed in sleeved relationship around the piston hammer between a piston portion of the piston hammer and an impact blow receiving bit. The tubular sleeve valve is provided with ports which communicate with high pressure and fluid exhaust ports in the piston hammer to effect reciprocation of the sleeve valve and of the piston hammer to deliver repeated impact blows to the bit. The bit may be configured to have a major portion of a transverse face disposed at an acute angle with respect to a plane normal to the bit and drill axis to allow directional drilling when the bit receives impact blows without being rotated. Retractable or fixed stabilizer or guide shoe members may be mounted on the exterior of the drill cylinder to aid in centering the drill in the drillhole or allow lateral deflection of the drill to accomplish directional drilling.

28 Claims, 6 Drawing Sheets

HYDRAULIC IN-THE-HOLE PERCUSSION ROCK DRILL

FIELD OF THE INVENTION

The present invention pertains to a pressure fluid actuated in-the-hole reciprocating piston hammer percussion rock drill including a single sleeve type pressure fluid distributing valve, fixed or bit actuated guide shoes and an improved directional or steerable drill bit.

BACKGROUND

In the art of pressure fluid actuated reciprocating piston percussion rock drills and similar percussion tools, it is known to provide the general configuration of the tool to include a sliding sleeve type valve for distributing pressure fluid to effect reciprocation of a fluid actuated piston hammer. There are many applications of these types of drills wherein the diameter of the hole to be drilled is relatively small, in the range of two to three inches, for example. Still further, there are also applications for reciprocating piston percussion rock drills and similar tools wherein the tool must be inserted within a conduit or tubing string for cleanout of the conduit or for utilization of the conduit as a guide structure.

One improvement in small diameter reciprocating piston percussion rock drills and the like is disclosed and claimed in my U.S. Pat. No. 5,680,904, issued Oct. 28, 1997. The percussion rock drill disclosed in the '904 patent includes opposed sleeve type valves disposed on opposite reduced diameter end portions of the reciprocating piston hammer, respectively, for movement with the piston hammer and for movement relative to the piston hammer to distribute pressure fluid to opposite sides of the piston hammer to effect reciprocation of same. Another advantageous design of a relatively small diameter fluid actuated percussion rock drill is disclosed and claimed in U.S. Pat. No. 4,828,048 to James R. Mayer and William N. Patterson. The drill described and claimed in the '048 patent utilizes a single sleeve type distributing valve disposed at the fluid inlet end of the drill cylinder. However, the construction of a drill in accordance with the '048 patent tends to restrict the minimum outside diameter or require that the fluid passages and/or the piston diameter be of inadequate size for certain applications.

Accordingly, since it is desirable to provide maximum drilling energy in most applications of percussion rock drills within the constraints of the requirements of the outer diameter of the drill, and it is also considered desirable to be able to "steer" the drill in certain applications thereof, there have continued to be needs for improvements in the construction of relatively small diameter hydraulic or other pressure fluid actuated percussion rock drills. It is in pursuit of these objectives that the present invention has been developed.

SUMMARY OF THE INVENTION

The present invention provides an improved pressure fluid actuated reciprocating piston percussion tool, particularly adapted for rock drilling. The invention contemplates, in particular, the provision of a relatively small diameter, hydraulically actuated, reciprocating piston type percussion rock drill which is characterized by a single sleeve type pressure fluid distributing valve which is mounted within the drill cylinder between the enlarged diameter piston portion of the reciprocating piston hammer and the forward, percussion bit end of the tool or drill.

In accordance with another aspect of the present invention, a hydraulically actuated reciprocating piston percussion rock drill is provided which includes a reciprocating sleeve type fluid distributing valve which is pressure fluid actuated to move in opposite directions in sleeved relationship around a reduced diameter hammer portion of the reciprocating piston hammer. The piston hammer is continually biased by pressure fluid in one direction and the sleeve valve operates to alternately pressurize and vent a pressure fluid chamber acting on the opposite side of the piston portion of the piston hammer to effect reciprocating impact blow delivering movement thereof.

In a preferred embodiment of the invention, a reciprocating piston percussion rock drill is provided with a unique tubular sleeve type pressure fluid distributing valve which is pressure fluid actuated to move in opposite directions and is cushioned by pressure fluid to arrest movement of the valve in both directions and to effect acceleration of the valve in the opposite direction.

In accordance with another aspect of the invention, a reciprocating piston pressure fluid actuated rock drill is provided with an improved construction and arrangement of a pressure fluid distributing valve and a reciprocating piston hammer which cooperate to provide for conducting pressure fluid through the piston hammer to the drill bit for hole flushing purposes without reciprocating the piston hammer.

In accordance with yet a further aspect of the present invention, a relatively small diameter pressure fluid actuated reciprocating piston percussion rock drill is provided which includes substantially unobstructed pressure fluid flow passages which improve the efficiency of the drill and result in converting more energy stored in the pressure fluid to percussion blows acting on the drill bit.

In accordance with still another aspect of the present invention, a reciprocating piston percussion type rock drill is provided with an improved arrangement of fixed and moveable stabilizer or guide shoe members mounted on the drill cylinder adjacent the bit end thereof. The present invention also provides a reciprocating piston percussion rock drill with an improved steerable or directional drill bit for use therewith for directional drilling purposes.

Still further, the present invention provides a hydraulic pressure fluid actuated reciprocating piston percussion rock drill or similar tool which includes an overall improved construction, provides for ease of assembly, disassembly and replacement of working parts, if necessary, is efficient in operation and is particularly adapted for drilling relatively small diameter holes.

Those skilled in the art will further appreciate the above-mentioned features and advantages of the invention together with other superior aspects thereof upon reading the detailed description which follows in conjunction with the drawing.

DETAILED DESCRIPTION OF PREFERRED EMBODIMENTS

Figure 1:
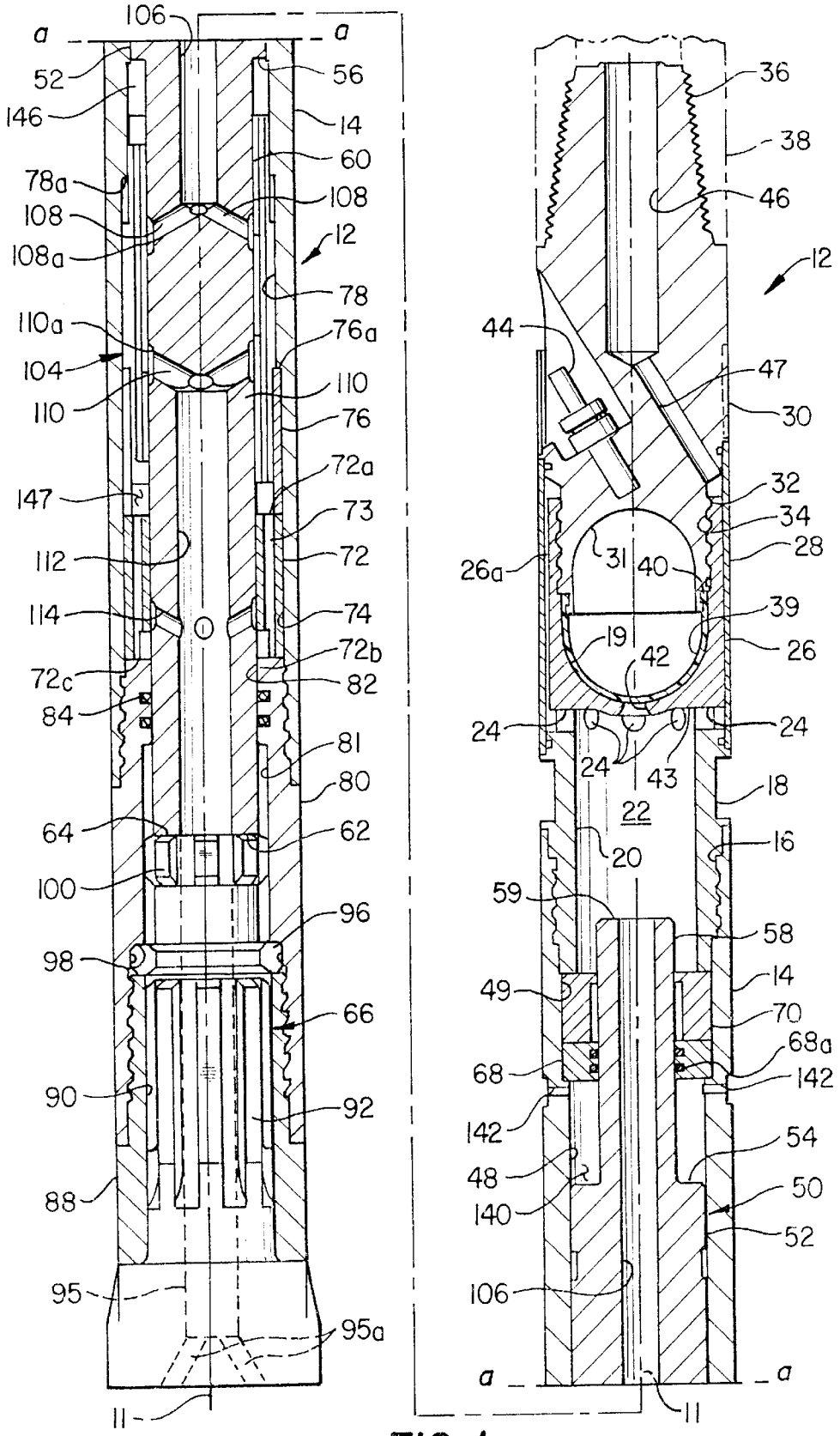
FIG. 1 is a longitudinal central section view of a hydraulically actuated reciprocating piston percussion rock drill in accordance with the present invention.

In the description which follows like parts are marked throughout the specification and drawing with the same reference numerals, respectively. The drawing figures are not necessarily to scale and certain features of the invention may be shown exaggerated in scale or in somewhat schematic form in the interest of clarity and conciseness.

Referring to FIG. 1, there is illustrated a longitudinal central section view of a hydraulically actuated reciprocating piston hammer percussion rock drill in accordance with the present invention and generally indicated by the numeral 12. FIG. 1 comprises a longitudinal central section view wherein the portions shown side by side are actually joined end to end at the line a—a of both figure portions. The drill 12 includes an elongated relatively small diameter tubular cylinder member 14 having an upper end provided with internal threads 16 for coupling the cylinder to a generally tubular cylindrical adapter member 18 which is provided with cooperating threads for threaded engagement with the cylinder 14. The adapter 18 includes a relatively large internal bore 20 providing a chamber 22 which is in fluid flow communication with a series of a circumferentially spaced radially extending fluid inlet ports 24. Ports 24 are in communication with an elongated annular passage 26 formed between an outer circumferential surface 26*a* of the adapter 18 and a tubular sleeve 28 which is secured in sleeve relationship around the adapter 18 by a cylindrical head member 30. The head member 30 is threadedly engaged with the adapter 18 at cooperating threads 32 and 34, respectively. The head member 30 also includes an upper, externally threaded distal end 36 adapted to connect the drill or tool 12 to an elongated pressure fluid conducting drillstem 38 of conventional construction.

The head 30 and the adapter 18 are provided with cooperating somewhat hemispherical shaped cavities 31 and 19, respectively, and the cavity 19, in particular, is also delimited by a flexible hemispherical shaped bladder member 39 secured at a peripheral edge 40 between the members 30 and 18, as illustrated. A port 42 formed in an end wall 43 of the bore 20 opens into the cavity 19 to provide an accumulator which may be charged with pressure gas through a suitable fitting 44 mounted on the head 30, as shown. Accordingly, the cavity 31 may be charged with pressure gas to minimize pressure fluctuations of high pressure hydraulic fluid, such as water, for example, which is introduced into the chamber 22 through an axial passage 46 in the head 30. Passage 46 includes a branch portion 47, as shown and which is in communication with the annular passage 26. Passage 26 opens into the chamber 22 through the ports 24.

Figure 1A:
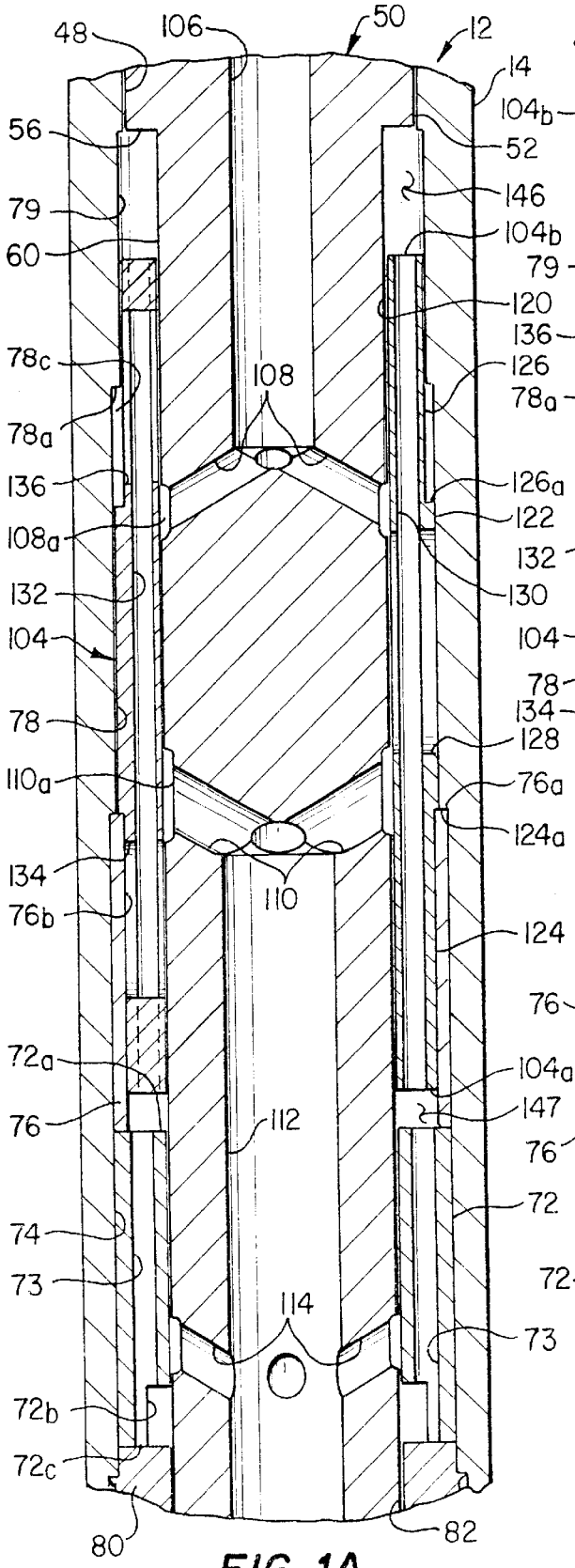
FIG. 1A is a detail section view similar to a portion of FIG. 1 on a larger scale and showing certain details of the sleeve type distributing valve.

Referring further to FIGS. 1 and 1A, the cylinder 14 includes a first internal bore 48 for receiving an elongated reciprocating piston hammer 50 in close fitting sliding relationship therein. The piston hammer 50 includes an enlarged diameter piston portion 52 having opposed transverse faces 54 and 56, a first elongated reduced diameter shank portion 58 extending from the transverse face 54 and a second elongated reduced diameter hammer shank portion 60 extending from the transverse face 56. The hammer portion 60 terminates in a transverse impact face 62, FIG. 1, forcibly engageable with a transverse face 64 of a percussion bit 66. An enlarged cylinder bore portion 49, FIG. 1, is adapted to receive a seal holder 68 and a piston hammer bearing 70 retained in the bore 49 by the adapter 18 when it is threadedly engaged with the cylinder 14, as shown. The bearing 70 is adapted to journal the reduced diameter shank portion 58 of hammer 50 for reciprocation therein. Suitable circumferential piston ring type seals 68*a* are disposed on seal holder 68 for engagement with piston hammer shank portion 58.

The opposite end of the piston hammer 50, including the hammer portion 60, is journaled in a tubular sleeve bearing 72 which is disposed in an enlarged diameter bore portion 74 of cylinder 14. A tubular spacer 76 is interposed the bearing 72 and a third cylinder bore portion 78 which terminates at a fourth bore portion 79 extending to the bore 48 of the cylinder 14. The bearing 72 is retained in the cylinder 14 by a cylindrical front housing member 80 which is threadedly engaged with the cylinder 14 at cooperating threads, as shown. The front housing 80 includes a cylindrical bore 82 for receiving the hammer shank portion 60 of the piston hammer 50 in close fitting sliding relationship therein. Suitable circumferential seal members 84 are retained on the front housing 80 for engagement with the shank portion 60, as shown in FIG. 1. Alternatively, labyrinth sealing between piston hammer 50 and seal holders 68 and front housing 80 may be provided.

The opposite end of the front housing 80 is threadedly engaged with a tubular chuck 88 having longitudinal internal splines 90 formed therein for engagement with cooperating splines 92 formed on percussion bit 66. A suitable axially split bit retainer ring 96 is interposed the bit chuck 88 and an annular groove 98 formed in the front housing 80 for engagement with bit head portion 100. The transverse face 64 is formed on and delimits the bit head portion 100, as illustrated. Accordingly, the bit 66 is adapted for limited axial sliding movement in the chuck 88 between the working position shown in FIG. 1 for receiving impact blows from the piston hammer 50 and an axially extended position wherein the head portion 100 engages the bit retainer ring 96 for a purpose to be explained further herein. An axial passage 95 formed in the bit 66 extends therethrough to the face 64 for receiving drill cuttings flushing fluid, such as water, which is operable to be conducted through the piston hammer 50 in a manner to be described in further detail herein, and then discharged through passages 95*a* in the bit.

Referring further to FIGS. 1 and 1A, the percussion drill 12 is advantageously provided with a reciprocating tubular sleeve valve member 104 which is disposed in the bore 78 of the cylinder 14 and in sleeved relationship around the hammer shank portion 60 of the piston hammer 50. The piston hammer 50 includes an axial fluid conducting passage 106 extending from end face 59 through the reduced diameter shank portion 58 and the piston portion 52 and intersecting generally transverse passages 108, which open to a circumferential groove 108*a* in the exterior surface of the shank portion 60. A second set of radially extending transverse passages 110 open to a circumferential groove 110*a* in the exterior surface of shank portion 60 at a point spaced axially from passages 108 and are in communication with an axial passage 112 extending through the shank portion 60 to the end face 62. A third set of circumferentially spaced radial or transverse passages 114 intersect the passage 112 at a point spaced from the passages 110, as shown in FIG. 1A.

As also shown in FIG. 1A, the tubular bearing member 72 is provided with plural circumferentially spaced axially extending passages 73 formed therein and extending from an end face 72*a* to a circumferential groove 72*b* opening to the opposite end face 72*c*. When the piston hammer 50 is moved downwardly, viewing FIGS. 1 and 1A, in response to the bit 66 being out of contact with a rock face, the passages 114 are placed in registration with groove 72*b* to allow pressure fluid to flow from chamber 22 through passage 106, passages 108 and suitable passages, to be described further herein, in valve 104, through passages 73 and 114 to passage 112 and then through passages 95, 95*a* in the bit to provide continuous flushing fluid to a drillhole in which the drill 12 may be disposed.

Figure 2:
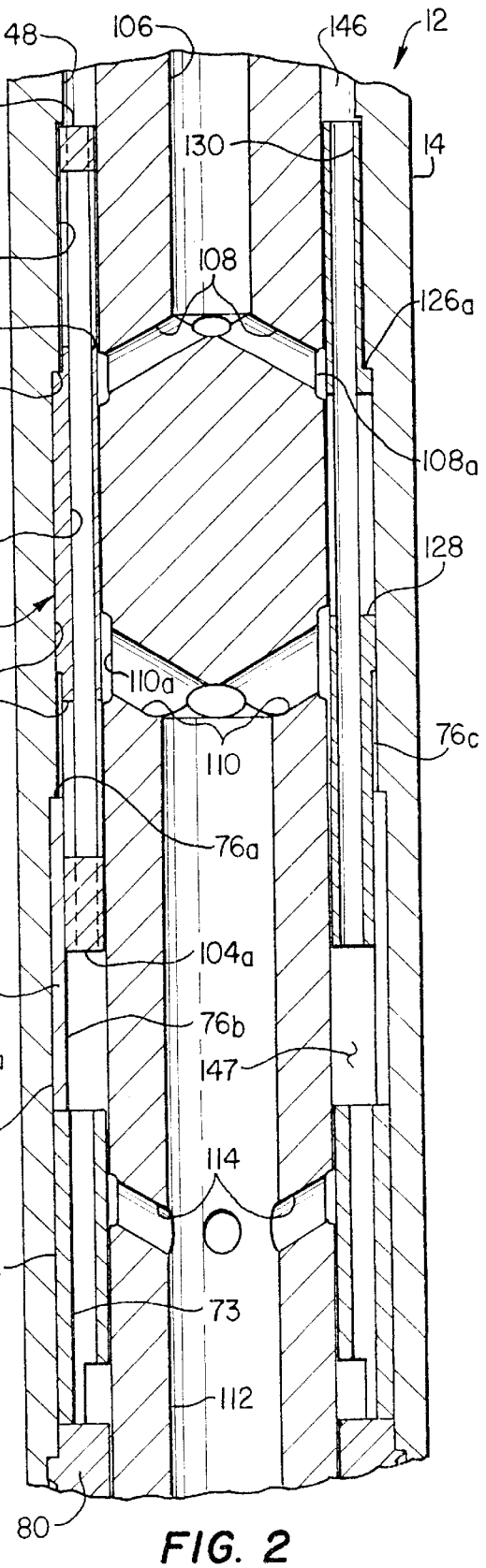
FIG. 2 is a detail view similar to FIG. 1A showing a rearward position of the sleeve type distributing valve and when the piston hammer is accelerating rearwardly away from the drill bit.

Referring to FIGS. 1A and 4 through 6, the tubular sleeve valve 104 comprises a cylindrical tubular member having opposed end faces 104*a* and 104*b* and a central bore 120. The sleeve valve 104 includes a central portion 122 having a diameter greater than opposed end portions 124 and 126 and forming transverse annular shoulders 124*a* and 126*a*, respectively. Valve end portion 124 is slidable in a bore 76*b* formed by the spacer 76, central portion 122 is slidable in close fitting relationship with bore 78 and valve end portion 126 is slidable in close fitting relationship in bore 79. When the valve 104 is assembled in the cylinder 14, as shown in FIGS. 1 and 1A, an annular chamber 78*c*, see FIG. 1A, is formed between shoulder 126*a* and a transverse shoulder 78*a*. Also, an annular chamber 76*c*, see FIG. 2, is formed between shoulder 124*a* and end face 76*a* of the spacer 76.

Figure 5:
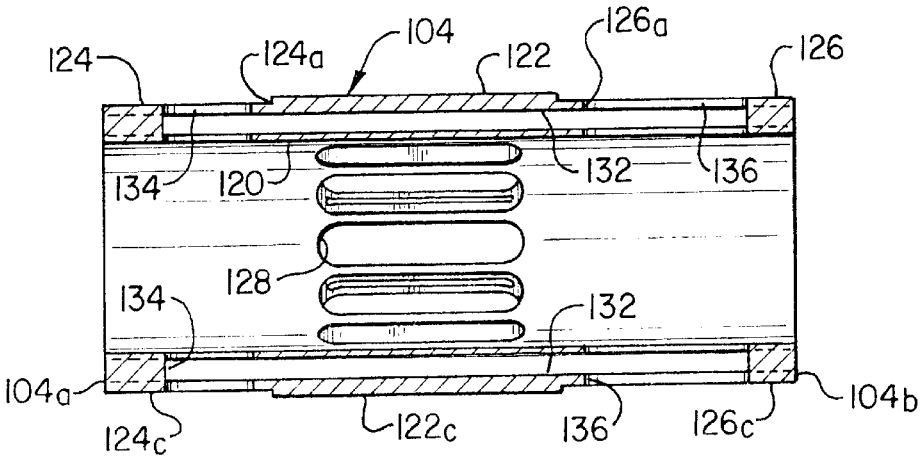
FIG. 5 is a longitudinal central section view taken from the line 5—5 of FIG. 4.
Figure 6:
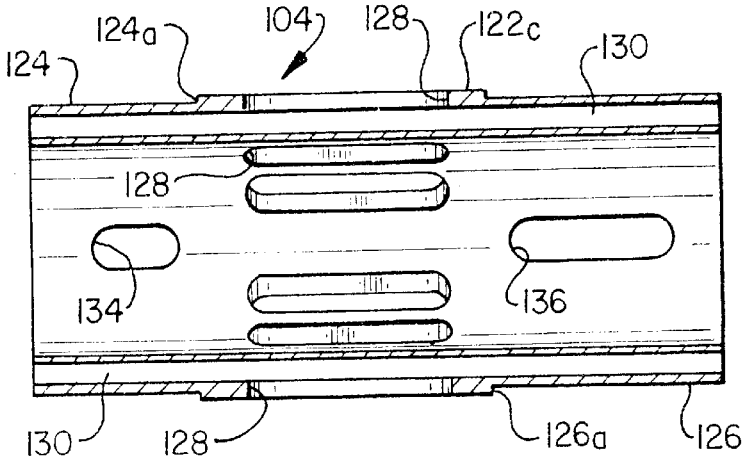
FIG. 6 is a longitudinal central section view taken from the line 6—6 of FIG. 4.

As shown in FIG. 6, a plurality of circumferentially spaced radially extending elongated ports 128 extend from the bore 120 to the outer circumferential surface 122*c* of the valve portion 122 and intersect a plurality of elongated circumferentially spaced passages 130 which extend between the end faces 104*a* and 104*b*. As shown in FIG. 5, certain elongated passages formed in the valve 104 are designated as passages 132, two sets of which are diametrically opposed and extend between radially extending ports 134 and 136 which also open from the bore 120 to the outer circumferential surfaces 124*c* and 126*c* of the reduced diameter end portions 124 and 126, respectively. As indicated in FIGS. 5 and 6, the ports 134 and 136 communicate with the fluid transfer passages 132, but these ports do not normally communicate with the passages 130 or the ports 128. The section views of valve 104 in FIGS. 1, 1A, 2 and 3 are taken at right angles through the valve to show all ports therein for clarity.

Referring again to FIG. 1, the disposition of the piston hammer 50 in cylinder 14 forms a chamber 140 between the piston face 54 and the seal member 68 which chamber is open to the exterior of the drill 12 through one or more radial vent ports 142. The annular end face 59 is constantly exposed to high pressure fluid in chamber 22 and this fluid is conducted through passage 106 to passages 108. When the piston hammer 50 is in the position shown in FIGS. 1 and 1A, it is considered that the piston hammer is at the impact point wherein a percussion blow is being delivered to the bit 66 at the end face 64. In this position of the piston hammer 50, the valve 104 has already moved forward to a position wherein passages 108 have been momentarily in communication with valve passages 130 through ports 128, as the piston hammer moved to the position shown, to allow high pressure fluid to flow through the passages 130 and into passages 73 and the annular groove 72*b*. However, in this position of the piston hammer 50, flow of fluid out of groove 72*b* is blocked by the shank portion 60. Also, in this position of the valve 104 relative to the hammer shank portion 60, pressure fluid flows into chamber 146 between piston hammer face 56 and the end of the valve 104 to act on the shoulder or face 56 to begin moving the piston hammer 50 rearwardly away from the bit 66.

In the position of the valve 104 and piston hammer 50 shown in FIGS. 1 and 1A, port 134 is just in communication with passages 110 by way of annular groove 110*a* placing the differential areas defined by the transverse shoulders 124*a* and 126*a* at a low pressure, as present in passage 112, and the drillhole being formed. Consequently, pressure fluid acting on end face 104*a*, which has an effective transverse face area greater than that of the end face 104*b*, will cause valve 104 to begin shifting rearwardly under the urging of pressure fluid in the same direction of movement as the piston hammer 50. The face areas and weights of the valve 104 and the piston hammer 50 are preferably configured such that the valve 104 moves faster than the piston hammer until the valve moves within the cylinder 14 rearwardly to the shoulder 78*a*. As soon as ports 136 move out of registration with annular chamber 78*c* formed between transverse faces 126*a* and 78*a*, pressure fluid is substantially trapped in the chamber to cushion rearward movement of the valve 104.

Rearward motion (upward viewing FIGS. 1 and 1A) of the valve 104 and piston hammer 50 continue at substantially constant acceleration until ports 136, passages 130 and ports 134 move out of registration with groove 110*a* and passages 110. Valve 104 moves rearwardly to the position shown in FIG. 2 while its motion is retarded by fluid in chamber 78*c* between transverse faces 78*a* and 126*a*. As the piston hammer 50 continues to move rearwardly, groove 110*a* and passages 110 register with valve ports 128, momentarily venting pressure fluid from chambers 146 and 147 to passage 112 while groove 108*a* and passages 108 move into fluid flow communication with ports 136. This action is just beginning in the positions of valve 104 and piston hammer 50 shown in FIG. 2. Since the transverse face area provided by the shoulder 126*a* is greater than provided by the shoulder 124*a*, the valve 104 is accelerated forwardly.

Figure 3:
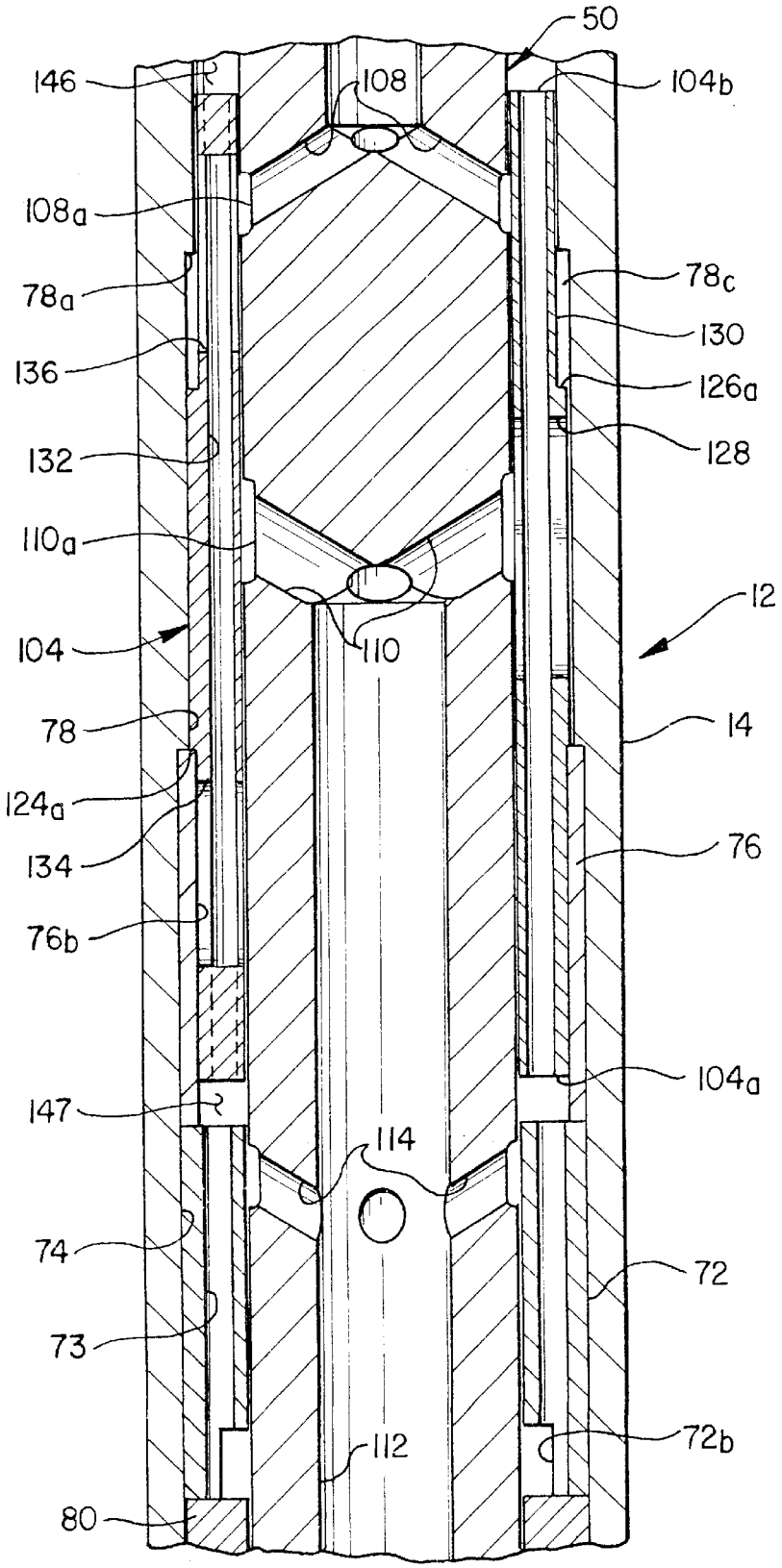
FIG. 3 is a view similar to FIG. 2 showing a forward position of the sleeve type distributing valve and when the hammer is accelerating toward impact of the drill bit.
Figure 4:
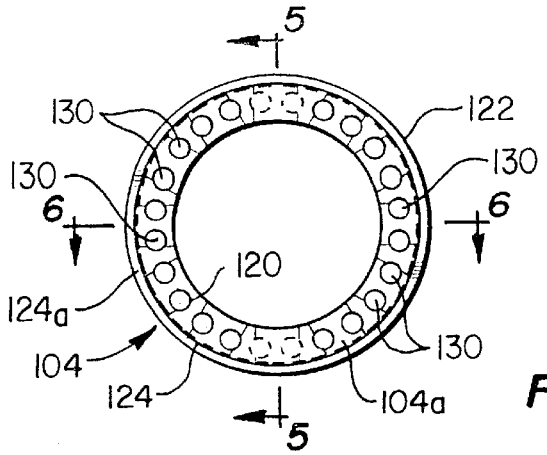
FIG. 4 is a transverse end view of the sleeve type distributing valve.

As the piston hammer 50 moves to its full rearward position, as shown in FIG. 3, valve 104 has already essentially moved to its full forward position, as shown, under the urging of pressure fluid, placing low pressure groove 110*a* and passages 110 in communication with ports 128 and passages 130 thereby venting the chamber 146 to passage 112. At this point, the effective face area provided by the shoulder 56, FIG. 1, is at a low pressure and since the transverse face 59 is continuously at a high pressure, the piston hammer 50 is accelerated forwardly to deliver an impact blow to bit 66. As the piston hammer 50 reaches the impact below delivery position, the cycle is complete and commences again, as described above.

Accordingly, the percussion drill 12 advantageously uses a minimum of pressure fluid to effect shifting of the valve 104, the valve is shifted by pressure fluid and not by impacting a shoulder on the piston hammer 50, thus increasing the operating lives of both the valve and the piston hammer, for example. The operating (impact blow delivering) frequency of the drill 12 and the impact blow energy are functions of piston hammer weight, face areas exposed to the alternating fluid pressures and the working fluid pressure of the drill.

As described above, if the drill 12 is moved off the "bottom" of a drillhole being formed so that the bit 66 is extended to where the bit head 100 engages the retaining ring 96, see FIG. 1, the piston hammer 50 will move downwardly into engagement with the end face 64 of the bit placing the passages 114 in registration with the groove 72*b*. In such position, the high pressure passages 108 and groove 108*a* are blocked from communicating with the ports 134 and 136, but allow fluid to flow from the passages 108 and groove 108*a* through ports 128 and passages 130 and through passages 73, annular groove 72*b* and passages 114 into passage 112 and bit central passage 95 to provide a continuous stream of pressure fluid to flush the drillhole. Once the drill 12 is thrust into engagement with a rock face not shown, and the bit 66 is moved to the position shown in FIG. 1, the piston hammer 50 is moved back into a working position which commences the operating cycle described above.

Figure 7:
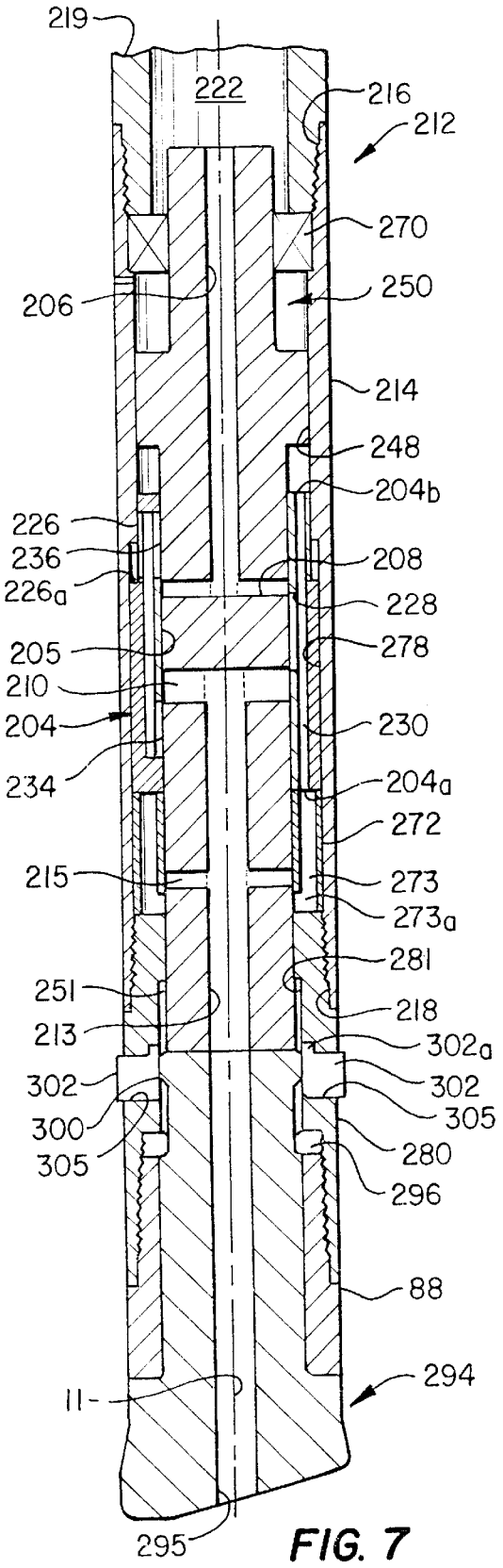
FIG. 7 is a longitudinal central section view of an alternate embodiment of a hydraulically actuated reciprocating piston percussion rock drill in accordance with the invention including a steerable drill bit and bit actuated retractable stabilizers.

Referring now to FIG. 7, an alternate embodiment of a hydraulically actuated reciprocating piston hammer percussion drill in accordance with the invention as illustrated and generally designated by the numeral 212. The drill 212 includes an elongated tubular cylinder member 214 having opposed internally threaded end parts 216 and 218 for connection to an adapter 219, similar to the adapter 18, a front housing 280 similar to the front housing 80 of the embodiment of FIG. 1, and a chuck 88 disposed in front housing 280. An elongated piston hammer 250 is disposed for reciprocating movement in a bore 248 of the cylinder 214 in substantially the same manner as the hammer 50 is operable in the cylinder 14. The cylinder 214, however, includes a first enlarged diameter bore portion 278 in which is disposed, for reciprocating movement therein, a tubular sleeve valve 204 similar in some respects to the valve 104, but having only one cushion shoulder portion 226*a* formed by a reduced diameter part 226. Valve 204 is provided with elongated fluid transfer ports 228 which are in communication with longitudinal passages 230 extending from one end 204*a* of the valve to the other end 204*b*, as shown. Transfer ports 234 and 236 open into valve bore 205 and provide for communication with piston hammer passages 210 and 208. Passages 210 are in communication with a longitudinal piston hammer exhaust passage 213 and passages 208 are in communication with a piston hammer pressure fluid inlet passage 206 which receives pressure fluid from a chamber 222 in the same manner that the piston hammer 50 receives pressure fluid.

Piston hammer 250 is disposed for reciprocating movement in opposed bearing members 270 and 272 disposed in the cylinder 214 and the front bearing member 272 has longitudinal passages 273 formed therein, includes opening rearwardly to be placed in communication with the passages 230. Passages 273 open radially inwardly at 273*a* and are operable to be placed in communication with the passages 215, depending to position of piston hammer 250 Passages 273 open radially inwardly to be in communication with passages 215 in piston hammer 250 when a drill bit 294 is moved out of its working position. In this respect, the percussion drill 212 operates in substantially the same manner as the percussion drill 12 when bit 294 is not forced against a rock face so that drill flushing fluid may flow through passage 206, passages 208 and 230, through passages 273, 273*a* and 215 and into passage 213 for exiting the drill 212 through a central passage 295 in bit 294.

Bit 294 is retained in the chuck 88 by a retaining ring 296 in the same manner, substantially, as the bit 94 is retained in the chuck 88 for the drill 12. Bit 294 has an annular head portion 300 which is operable to engage plural circumferentially spaced retractable stabilizer members 302 which are shown disposed in plural circumferentially spaced slots 305 formed in the front housing 280. Each of the stabilizers 302 includes an axially extending key part 302*a* adapted to retain the stabilizers, respectively, within the slots 305. Preferably, four or more of the retractable stabilizers 302 are provided in equal circumferentially spaced slots 305 in the housing 280.

The operation of the drill 212 is substantially like that of the drill 12, although the bit 294 may be of a type adapted for directional drilling as will be explained in further detail herein. The sleeve valve 204 is reciprocated in substantially the same manner as the valve 104 for the drill 12 previously described. When the drill 212 is operating with the bit 294 forced rearwardly into the position shown in FIG. 7, the annular head portion 300 forces the stabilizers 302 to extend radially into contact with the bore wall of the hole, not shown, being drilled by the drill 212 to center the drill in the hole and maintain a substantially straight drillhole. However, when the drill 212 and a drill stem, not shown, connected thereto is not being rotated, the bit 294 may be allowed to extend axially in such a way that the head portion 300 moves toward the retaining ring 296 out of engagement with the stabilizers 302. Under these circumstances, the stabilizers 302 may retract into housing bore 281 until engagement with the reduced diameter forward shank portion 251 of piston hammer 250 whereby the drill may be moved sideways in the drillhole by applying a lateral force to the drill stem to which the drill 212 is connected. This will allow for changing the direction of the drillhole. Once the drill bit 294 has been forcibly urged back into the position shown in FIG. 7, the stabilizers 302 are radially extended to the positions shown to continue drilling in the new direction. The configuration of the bit 294 assists in this operation.

Figure 8:
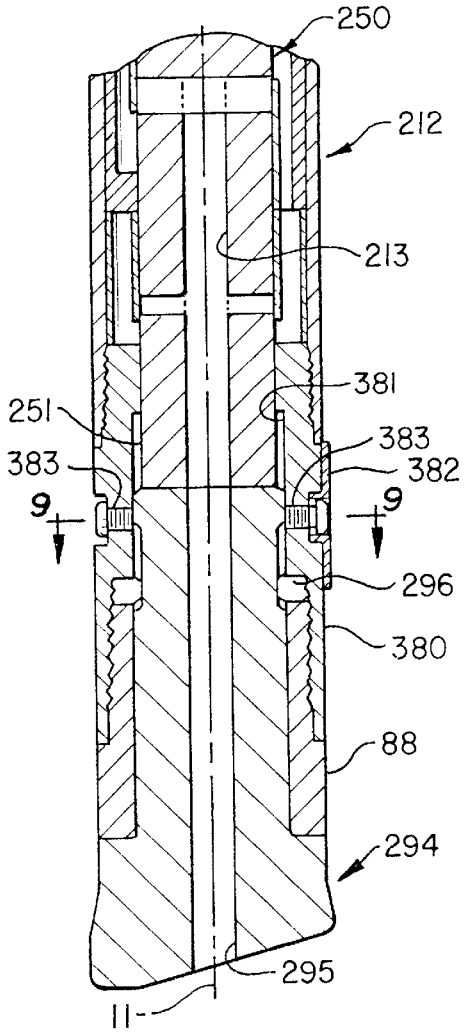
FIG. 8 is a view similar to FIG. 7 showing a modification of the drill cylinder front housing with fixed replaceable guide shoes supported thereon.
Figure 9:
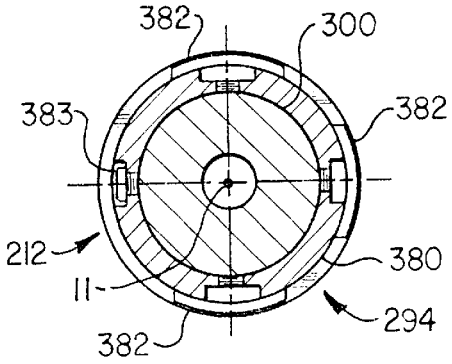
FIG. 9 is a transverse section view taken generally along the line 9—9 of FIG. 8.

Referring now to FIGS. 8 and 9, there is illustrated a modification of the drill 212 wherein the front housing 280 is replaced by a front housing 380 having a bore 381 for receiving the bit 294 which is retained in a chuck 88 by a retaining ring 296. In the modification of the drill 212 shown in FIGS. 8 and 9, the stabilizers 302 are replaced by an asymmetric arrangement of replaceable guide shoes 382, three shown arranged 90° apart from each other about the longitudinal central axis 11 of the drill 212. The guide shoes 382 are suitably connected to the front housing 380 by suitable threaded fasteners 383. The placement of the stabilizers 382 in an asymmetrical pattern, as illustrated in FIG. 9, for example, is such that the drill 212 may be moved sideways in the desired direction when the drill is not being rotated but while hammering on the bit 294. When the drill 212 is being rotated about axis 11 while delivering impact blows through the bit 294 to form the drillhole, the bit will tend to be centered in the drillhole and maintain a predetermined hole direction. The number and placement of the stabilizers or guide shoes 382 may be varied depending on the type and composition of the rock being drilled. Moreover, during use, the location and number of stabilizers or guide shoes 382 may be changed to accommodate different operating conditions.

Figure 11:
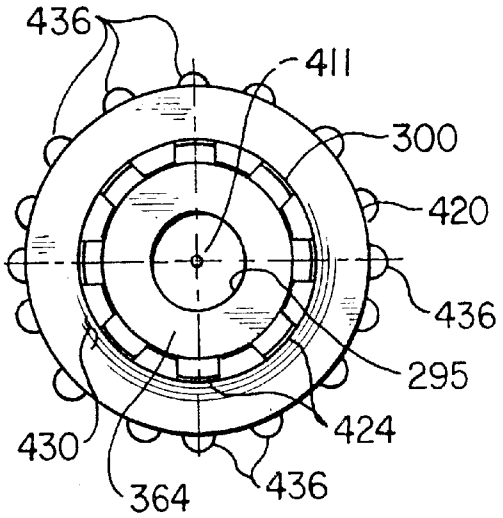
FIG. 11 is an end view of the bit shown in FIG. 10.
Figure 10:
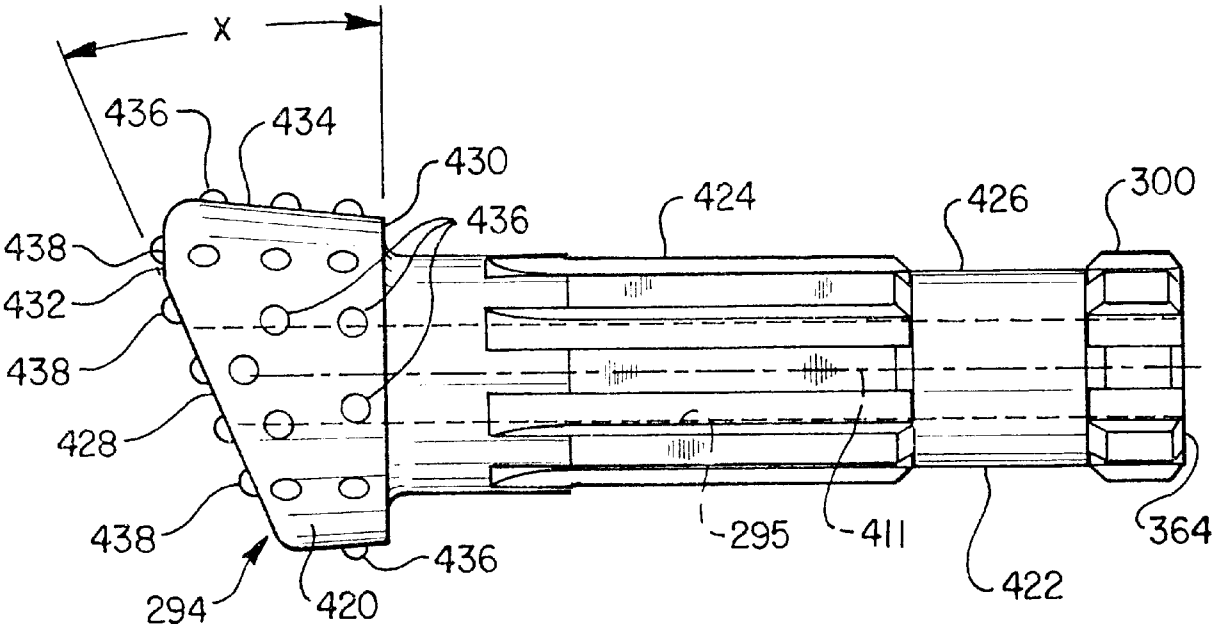
FIG. 10 is a side elevation of a steerable drill bit.

Referring now to FIGS. 10 and 11, the bit 294 is shown in side elevation and end view, respectively. As shown in FIG. 10, the bit 294 is provided with a generally cylindrical asymmetric head portion 420 and a reduced diameter elongated generally cylindrical shank 422. The shank 422 is adapted to include longitudinal circumferentially spaced splines 424 engageable with the chuck 88 in a manner known to those skilled in the art so that the bit will rotate with rotation of the drill 12 or 212 with which the bit is used. A circumferential groove 426 formed in the shank 422 defines the head portion 300 including a transverse hammer impact face 364. An elongated central flushing fluid passage 295 extends centrally through the shank 422 and the bit head 420. The bit head 420 is of a configuration to provide for directional drilling using a drill such as the drill 12 or 212 with the bit 294 fitted therein.

The bit head 420 is of unique configuration in that a substantial portion of the bit end face 428 is formed at an acute angle "x" with respect to a transverse annular shoulder portion 430 which extends in a plane normal to the bit central longitudinal axis 411. However, a portion of the end face 428, indicated at 432, and laterally spaced from the axis 411, is substantially parallel to the shoulder 430, and also extending in a plane normal to the axis 411. The angle "x" is determined for a bit according to hardness of the rock being drilled. For example, relatively hard rock would require a smaller or shallower angle "x" than relatively soft rock. Moreover, a pattern of hard metal or so-called carbide inserts are mounted on the head 420 in a pattern which will provide crushing or chipping of the rock as the drill hole is being formed. In normal operation, the drill, to which the bit 294 is connected, will be rotated in a cyclic manner (oscillation) through an angle of rotation or oscillation approximately equal to the spacing of the inserts, this oscillatory or "wiggling" motion of the drill presents new unbroken rock face to be chipped by the bit inserts in response to impact blows being delivered to the bit. The head 420 is also provided with, at least along a portion adjacent the face 432, a surface 434 extending at a shallow to moderate acute angle with respect to the axis 411 to provide relief or side clearance when forming a drillhole.

Suitable hard metal or so-called carbide bit inserts 436 are mounted on the head 420 along the surface 434 as well as being circumferentially spaced about the head as shown. Suitable hard metal inserts 438 are also provided in a predetermined pattern on the faces 428 and 432, as described above, and the oscillation angle of rotation about axis 411 will be such, in operation, as to present new rock face to inserts 438, in particular.

Accordingly, the bit 294 is provided with a unique head and face configuration which provides for directional drilling when used with a tool such as the drill 12 or 212, for example. When the bit 294 is being impacted by the piston hammer of the drill 12 or 212, without rotating the bit and the drill, the arrangement of the faces 428 and 432 is such as to tend to deflect the bit laterally to thereby change the direction of the drillhole. However, when the bit 294 is being rotated with the drill 12 or 212 and impacted to crush rock and form a drillhole, the drillhole will proceed substantially straight or coaxial with the axis 411, for example. In this way, directional drilling may be accomplished with the drill 12 or 212 when using the bit 294 therein. Suitable sensors mounted on the drill, not shown, may be used to indicate the direction of the hole as it is formed.

The construction and operation of the drills 12, 212 and associated parts, including the bit 294, may be carried out using conventional materials and engineering practices known to those skilled in the art of hydraulic percussion rock drills and the like. Although preferred embodiments of the invention have been described in detail herein, those skilled in the art will recognize that various substitutions and modifications may be made to the invention without departing from the scope and spirit of the appended claims.

What is claimed is:

1. A pressure fluid operated reciprocating piston hammer percussion tool comprising:

an elongated cylinder including a central bore;

a reciprocating piston hammer disposed in said bore for reciprocation under the urging of pressure fluid supplied to first and second chambers formed in said cylinder;

an impact blow receiving member supported on said tool and operable to receive repeated impact blows from said piston hammer; and a generally tubular sleeve valve disposed in said cylinder between said piston hammer and said impact blow receiving member and reciprocable in said cylinder to effect valving pressure fluid to and venting pressure fluid from one of said chambers to effect reciprocation of said piston hammer to deliver repeated impact blows to said impact blow receiving member.

2. The percussion tool set forth in claim 1 wherein:

said valve is operable to be reciprocated in said cylinder by pressure fluid forces acting thereon.

3. The percussion tool set forth in claim 2 wherein:

said piston hammer includes elongated passage means formed therein for conducting pressure fluid to said one chamber.

4. The percussion tool set forth in claim 3 wherein:

said piston hammer includes a first reduced diameter portion disposed within said valve and said elongated passage means in said piston hammer is in communication with first radially extending passage means opening into passage means formed in said valve for communicating pressure fluid to said one chamber.

5. The percussion tool set forth in claim 4 wherein:

said piston hammer includes second passage means formed therein and operable to be in communication with said passage means in said valve for venting pressure fluid from said one chamber.

6. The percussion tool set forth in claim 5 including;

exhaust passage means formed in said piston hammer and in communication with said second passage means for conducting pressure fluid from said one chamber to the exterior of said tool through said passage means in said valve.

7. The percussion tool set forth in claim 6 including:

third radially extending passage means in said piston hammer and operable to be in communication with passage means in said cylinder for conducting pressure fluid through said elongated passage means in said piston hammer and said passage means in said valve to said exhaust passage means in said piston hammer to provide pressure fluid to be conducted through said percussion tool without reciprocating said piston hammer.

8. The percussion tool set forth in claim 7 wherein:

said third passage means is operable to conduct high pressure fluid through said exhaust passage means in said piston hammer when said bit has moved to a non-working position with respect to said cylinder.

9. The percussion tool set forth in claim 2 wherein:

said valve includes opposed pressure faces formed thereon and responsive to exposure to pressure fluid to effect reciprocation of said valve in response to reciprocation of said piston hammer.

10. The percussion tool set forth in claim 9 wherein:

said valve includes at least one transverse cushion shoulder formed thereon and cooperable with a transverse surface formed in said cylinder to cushion movement of said valve in at least one direction.

11. The percussion tool set forth in claim 10 wherein:

said valve includes opposed cushion shoulders formed thereon and cooperable with opposed transverse surfaces formed in said cylinder for cushioning movement of said valve in both directions.

12. The percussion tool set forth in claim 11 wherein:

said valve includes port means formed therein and operable to be in communication with at least one cushion chamber formed between said valve and said cylinder for conducting pressure fluid to or venting pressure fluid from said cushion chamber.

13. The percussion tool set forth in claim 9 wherein:

said valve includes circumferentially spaced ports formed therein and in communication with longitudinal passages in said valve extending between said opposed pressure faces, said ports being adapted to be in communication with passage means formed in said piston hammer for conducting pressure fluid to and venting pressure fluid from said one chamber.

14. The percussion tool set forth in claim 1 wherein:

said piston hammer includes a piston portion slidably disposed in close fitting relationship in said bore in said cylinder, a first reduced diameter shank portion extending in one direction from said piston portion and a second reduced diameter shank portion extending in the opposite direction from said piston portion, said first reduced diameter shank portion extending within a bearing member disposed in said cylinder, and a third chamber formed in said cylinder by said piston hammer including said piston portion and said first shank portion.

15. The percussion tool set forth in claim 14 wherein:

said third chamber is in communication with passage means formed in said percussion tool for venting said third chamber to the exterior of said percussion tool.

16. The percussion tool set forth in claim 1 including:

a backhead member connected to said cylinder and an accumulator formed in said backhead member and in communication with at least one of said first and second chambers in said cylinder for receiving pressure fluid to act on said piston hammer at a substantially constant pressure.

17. The percussion tool set forth in claim 1 wherein:

said blow receiving member is mounted in a housing member of said cylinder, said housing member supporting radially extending stabilizer members operable to extend laterally from a central axis of said percussion tool for engagement with a borewall of a drillhole to stabilize and center said percussion tool in said drillhole.

18. The percussion tool set forth in claim 17 wherein:

said stabilizer members comprise a plurality of circumferentially spaced radially extending members supported for lateral movement on said housing member between a working position and a non-working position in response to movement of said blow receiving member axially in said housing member.

19. The percussion tool set forth in claim 1 including:

a plurality of guide shoes fixed to an exterior surface of said cylinder in a predetermined pattern to provide lateral deflection of said percussion tool and said drillhole in a predetermined direction when said percussion tool is operated to impact said blow receiving member to form said drillhole without rotating said percussion tool in said drill hole.

20. The percussion tool set forth in claim 1 wherein:

said blow receiving member comprise a drill bit including a head part and a shank part extending axially from said head part, said head part including a bit face extending at an acute angle with respect to a plane normal to the axis of said bit and a part of said bit face extending in said plane normal to said axis of said bit for biasing said bit to deflect laterally in response to receiving impact blows from said piston hammer to change the direction of a drillhole.

21. A pressure fluid operated reciprocating piston hammer percussion tool comprising:

an elongated cylinder including a central bore;

a reciprocating piston hammer disposed in said bore for reciprocation under the urging of pressure fluid supplied to first and second chambers formed in said cylinder;

an impact blow receiving bit supported on said tool and operable to receive repeated impact blows from said piston hammer, said bit is mounted in a housing member of said cylinder; and said housing member supporting radially extending stabilizer members operable to extend laterally from a central axis of said percussion tool for engagement with a borewall of drill hole to stabilize and center said percussion tool in said drillhole.

22. The percussion tool set forth in claim 21 wherein:

said stabilizer members comprise a plurality of circumferentially spaced radially extending members supported for lateral movement on said housing member between a working position and a non-working position in response to movement of said bit axially in said housing member.

23. The percussion tool set forth in claim 21 wherein:

said bit includes a head part and a shank part extending axially from said head part, said head part including a bit face extending at an acute angle with respect to a plane normal to the axis of said bit and a part of said bit face extending in said plane normal to said axis of said bit for biasing said bit to deflect laterally in response to receiving impact blows from said piston hammer to change the direction of a drillhole.

24. A pressure fluid operated reciprocating piston hammer percussion tool comprising:

an elongated cylinder including a central bore;

a reciprocating piston hammer disposed in said bore for reciprocation under the urging of pressure fluid supplied to first and second chambers formed in said cylinder;

an impact blow receiving bit supported on said tool and operable to receive repeated impact blows from said piston hammer; and a plurality of guide shoes fixed to an exterior surface of said tool in a predetermined pattern to provide lateral deflection of said tool and a drillhole in a predetermined direction when said tool is operated to impact said bit to form said drillhole without rotating said percussion tool in said drillhole.

25. The percussion tool set forth in claim 24 wherein:

said bit includes a head part and a shank part extending axially from said head part, said head part including a bit face extending at an acute angle with respect to a plane normal to the axis of said bit and part of said bit face extending in said plane normal to said axis of said bit for biasing said bit to deflect laterally in response to receiving impact blows from said piston hammer to change the direction of a drillhole.

26. In a pressure fluid operated reciprocating piston hammer percussion tool comprising:

an elongated cylinder including a central bore;

a reciprocating piston hammer disposed in said bore for reciprocation under the urging of pressure fluid acting thereon;

an impact blow receiving bit supported on said tool and operable to receive repeated impact blows from said piston hammer, said bit including a head part and a shank part extending axially from said head part, said head part including a face, a major portion of said face extending at an acute angle with respect to a plane normal to the longitudinal central axis of said bit for biasing said bit to deflect laterally in response to receiving impact blows from said piston hammer to change the direction of a drillhole being formed by said tool.

27. The invention set forth in claim 26 wherein:

a part of said face extends in a plane normal to said axis and said part of said face is disposed spaced laterally from said axis.

28. The invention set forth in claim 26 including:

rock crushing inserts disposed on said major portion and said part of said face, respectively.

* * * * *